US009252511B2

(12) United States Patent
Wang

(10) Patent No.: US 9,252,511 B2
(45) Date of Patent: Feb. 2, 2016

(54) CARD EDGE CONNECTOR WITH SOLDERING MEMBERS IN DIFFERENT POSITIONS

(71) Applicant: HON HAI PRECISION INDUSTRY CO., LTD., New Taipei (TW)

(72) Inventor: Jian Wang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 20 days.

(21) Appl. No.: 14/135,380

(22) Filed: Dec. 19, 2013

(65) Prior Publication Data

US 2014/0170882 A1 Jun. 19, 2014

(30) Foreign Application Priority Data

Dec. 19, 2012 (CN) ..... 2012 2 0705339 U

(51) Int. Cl.

| | |
|---|---|
| ***H01R 12/70*** | (2011.01) |
| *H01R 12/72* | (2011.01) |
| *H01R 12/83* | (2011.01) |
| *H01R 12/50* | (2011.01) |
| *H01R 13/506* | (2006.01) |

(52) U.S. Cl.

CPC ..... *H01R 12/707* (2013.01); *H01R 12/727* (2013.01); *H01R 12/721* (2013.01); *H01R 12/83* (2013.01); *H01R 13/506* (2013.01); *H01R 23/682* (2013.01)

(58) Field of Classification Search

CPC .... H01R 23/682; H01R 12/721; H01R 12/83; H01R 12/707; H01R 13/506; H01R 12/7005

USPC ..... 439/326, 328, 387, 159, 327

See application file for complete search history.

(56) References Cited

U.S. PATENT DOCUMENTS

| | | | | |
|---|---|---|---|---|
| 6,726,499 | B1 * | 4/2004 | Yu | 439/328 |
| 8,465,314 | B2 * | 6/2013 | Kato | H01R 12/721 439/327 |
| 2013/0171863 | A1 * | 7/2013 | Wang | H01R 12/83 439/387 |

FOREIGN PATENT DOCUMENTS

| | | |
|---|---|---|
| TW | 1264167 | 10/2006 |
| TW | M391202 U1 | 10/2010 |

OTHER PUBLICATIONS

DDR and GDDR5M Sodimm 256 Pin Socket, 0,50MM Pitch.

* cited by examiner

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

A card edge connector for connecting a printed circuit board, includes an insulative housing defining an elongated base portion, a first and a second end portions located on both ends of the base portion and a pair of locking arms respectively extending forwardly from the first and second end portions. A plurality of conductive terminals are received in the insulative housing. A first soldering member is mounted on the first end portion and includes a soldering portion located below the corresponding locking arm. A second soldering member is mounted on the second end portion and includes a soldering portion located below the corresponding locking arm. The distance between the soldering portion of the first soldering member and the first end portion in a front-to-rear direction is different from the distance between the soldering portion of the second soldering member and the second end portion in the front-to-rear direction.

20 Claims, 5 Drawing Sheets

CARD EDGE CONNECTOR WITH SOLDERING MEMBERS IN DIFFERENT POSITIONS

BACKGROUND OF THE INVENTION

1. Field of the Invention

The present invention relates to a card edge connector, and more particularly to a card edge connector having two soldering members offset with each other in a front-to-rear direction.

2. Description of the Related Art

Taiwan Pat. No. 1264167 issued on Oct. 11, 2006, discloses a card edge connector used for electrically connecting an electrical card to a mother board and including an elongated insulative housing, a pair of plastic arms extending forwardly from both ends of the insulative housing and a plurality of conductive terminals retained in the insulative housing. A pair of locking mechanisms is assembled to the plastic arms, respectively, and each locking mechanism includes a locking member locked on the electrical card and a soldering member soldered on the mother board, the soldering portions of the two soldering members are located in one line in a face-to-face manner along a longitudinal direction. However, when the soldering pads of the mother board used for soldering the soldering members are offset with each other in the front-to-rear direction, this card edge connector can not be used. In fact, recently one layout design of the PCB (printed circuit board) was announced by others to form an electrical connector area with two opposite soldering pads at two opposite ends in the lengthwise direction while being offset from each other in the front-to-back direction perpendicular to the lengthwise direction.

Therefore, an improved card edge connector is highly desired to meet this offset soldering pad requirement while maintaining flexibility of manufacturing and assembling for lowering the cost due to variable positions of the offset arrangement of the soldering pads on the mother board.

BRIEF SUMMARY OF THE INVENTION

An object of the present invention is to provide a card edge connector with the soldering portions of first and second soldering members offset with each other in a front-to-rear direction.

In order to the achieve above-mentioned object, a card edge connector for connecting an electrical card to a printed circuit board, defines an insulative housing defining an elongated base portion, first and second end portions located on both ends of the base portion and a pair of locking arms respectively extending forwardly from the first and second end portions, the base portion defines a central slot extending along a longitudinal direction for receiving the electrical card. A plurality of conductive terminals is received in the insulative housing and projecting into the central slot. A first soldering member is mounted on the first end portion and includes a soldering portion located below the corresponding locking arm for soldering on the printed circuit board. And a second soldering member is mounted on the second end portion and includes a soldering portion located below the corresponding locking arm for soldering on the printed circuit board. The distance between the soldering portion of the first soldering member and the first end portion in a front-to-rear direction is different from the distance between the soldering portion of the second soldering member and the second end portion in the front-to-rear direction.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
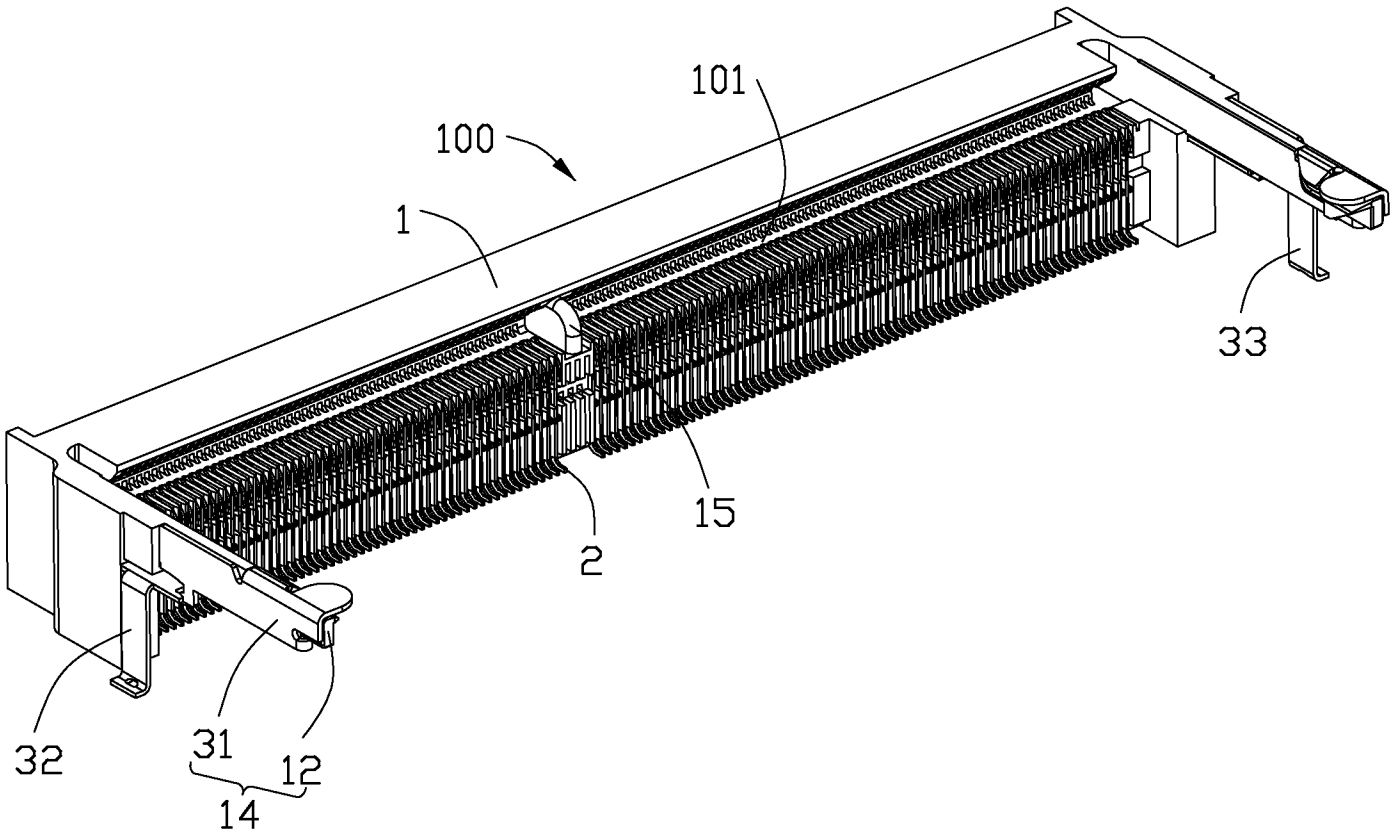
FIG. 1 is a perspective view of a card edge connector in accordance with the present invention.

Reference will now be made to the drawing figures to describe a preferred embodiment of the present invention in detail. FIG. 1 discloses a card edge connector 100 in accordance with the present invention. The card edge connector 100 includes an insulative housing 1, a plurality of conductive terminals 2 retaining in the insulative housing 1, a first soldering member 32 and a second soldering member 33. To efficiently illustrate the structural relationship among different elements, as shown in FIG. 2, the longitudinal direction is defined along X-X, the front-to-rear direction is defined along Y-Y and the vertical direction is defined along Z-Z.

Figure 2:
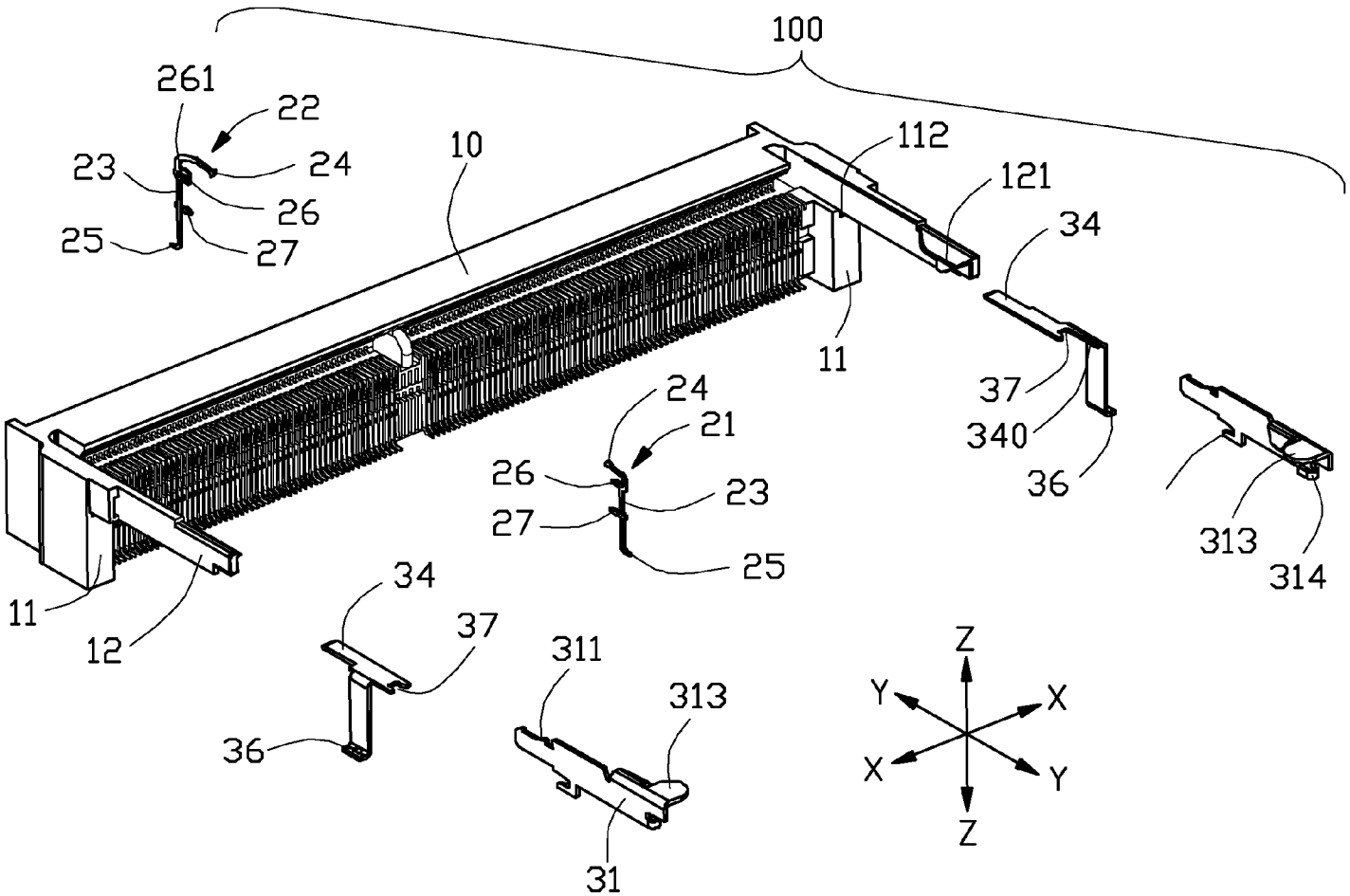
FIG. 2 is an exploded perspective view of the card edge connector shown in FIG. 1.

Referring to FIGS. 1 to 2, the insulative housing 1 includes an elongated base portion 10 and a pair of end portions 11 located on both ends of the base portion 10. The base portion 10 defines a narrow central slot 101 extending along a longitudinal direction for receiving an electrical card, and a key 15 is disposed in the central slot 10 to prevent the electrical card from being inserted into the central slot 101 in an incorrect direction. Each end portion 11 defines a plastic arm 12 extending forwardly and a metal arm 31 covering the plastic arm 12, the plastic arm 12 and the metal arm 13 together function as a locking arm 14 for clamping the electrical card. A locking portion 121 projects from the inner side of the plastic arm 12 and is used for locking the electrical card. The end portion 11 defines a mounting slot 112 located below the plastic arm 12, and the first soldering member 32 and the second soldering member 33 are mounted in the corresponding mounting slots 112, respectively.

The conductive terminals 2 include a plurality of first terminals 21 and a plurality of second terminals 22 which arranged in two rows. Each conductive terminal 2 defines a body portion 23 accommodated in the base portion 10, a contacting portion 24 extending from the top portion of the body portion 23 and projecting into the central slot 101, and a soldering portion 25 extending from the bottom portion of the body portion 23, the body portion 23 connects with the contacting portion 24 and the soldering portion 25. The contacting portions 24 of the first terminal 21 and the second terminal 22 are located on the upper and lower sides of the central slot 101 respectively and offer set in a front-to-rear direction. The body portion 23 defines a first retaining portion 26 and a second retaining portion 27 extending into the base portion 10, the first retaining portion 26 and the second retaining portion 27 are set in different heights in a vertical direction. The first retaining portion 26 of the second terminal 22 has a hollow hole 261 used to reduce the distance between the first retaining portion 26 and the contacting portions 24, thereby reducing affect to the strength of the second terminal 22 caused by greater distance between the first retaining portion 26 and the contacting portions 24.

The metal arm 31 is plate-shaped and vertically attached to the outer face of the plastic arm 12, and the metal arm 31 is retained in the end portion 11 by a barb 311 disposed at a rear direction thereof. The metal arm 31 defines a blocking portion 313 extending inwardly to engage with the electrical card and a hook 314 bending in a front end to engage with the plastic arm 12 in the front end thereof. The blocking portion 313 and the hook 314 are located in the same side of the metal arm 31, the blocking portion 313 extends across the plastic arm 12 from an upper side thereof, and the hook 314 is located below the blocking portion 313. Each metal arm 31 defines a stopping portion 315 extending to the barb 311 at a lower side thereof, and each stopping portion 315 abuts against a front end of the first soldering member 32 and the second soldering member 33 respectively.

Figure 3:
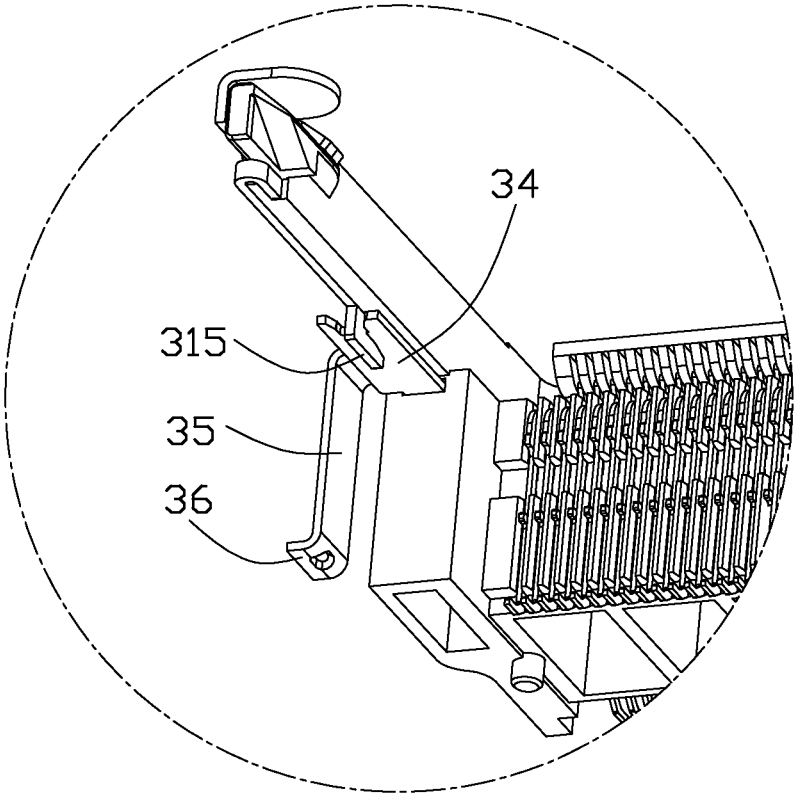
FIG. 3 is a partially enlarged view shown left side of the card edge connector of FIG. 1.
Figure 4:
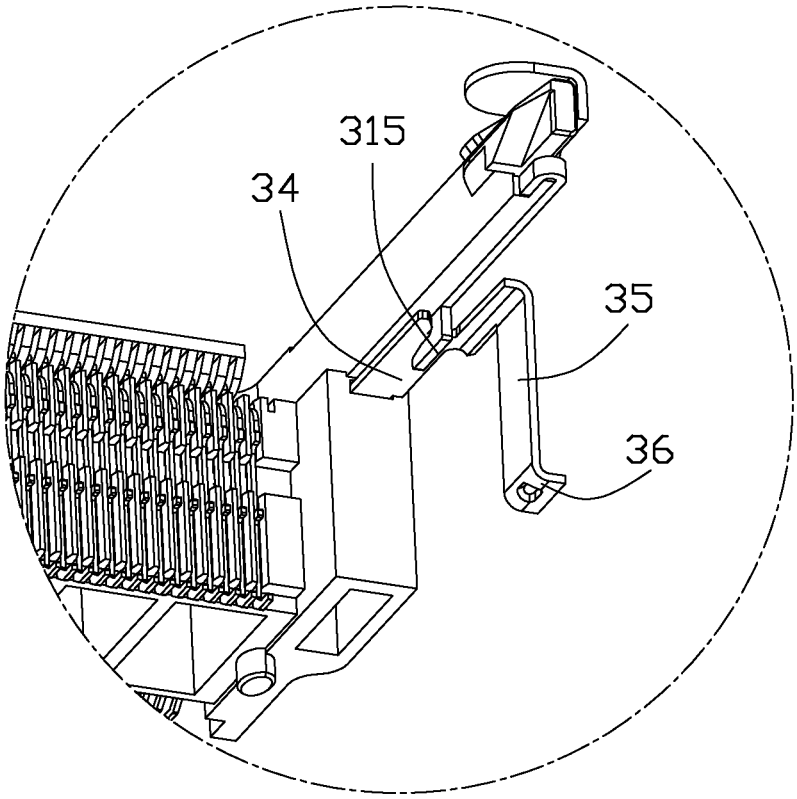
FIG. 4 is a partially enlarged view shown right side of the card edge connector of FIG. 1.
Figure 5:
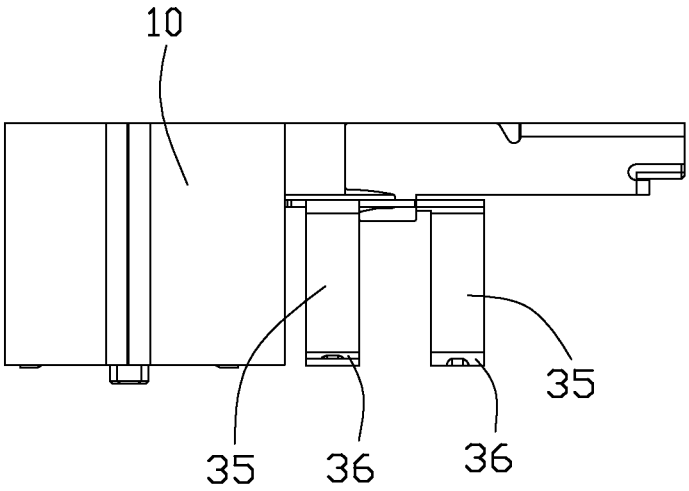
FIG. 5 is a left view of the card edge connector of FIG. 1.

Referring to FIGS. 2 to 4, the first soldering member 32 and the second soldering member 33 are respectively retained to the pair of end portions 11 and each is located below the locking arm 14. The first soldering member 32 and the second soldering member 33 each includes a horizontal section 34 and a vertical section 35 bending downwardly from the horizontal section 34 thereof. The rear portion of the horizontal section 34 is retained into the mounting slot 112, and a soldering portion 36 is bent from the free end of the vertical section 35 to be soldered on a printed circuit board. The horizontal section 34 defines a notch or engagement section 37 at a front end thereof, the stopping portion 315 latches with the notch 37 of the metal arm 31 to prevent the first soldering member 32 and the second soldering member 33 from forwardly breaking away from the end portion 11. The distance between the notch 37 of the first soldering member 32 and the first end portion 11 is similar to the distance between the notch 37 of the second soldering member 33 and the corresponding second end portion 11 in the front-to-rear direction. Referring to FIG. 5, the vertical section 35 of the first soldering member 32 outwardly bends from one side edge of the horizontal section 34 from a middle portion thereof, the horizontal section 34 of the second soldering member 33 forwardly extends to provide a connecting potion 340 at a front end thereof, and the vertical section 35 of the second soldering member 33 outwardly bends from the connecting portion 340. Therefore, the distance between the vertical section 35 of the first soldering member 32 and the first end portion 11 is different from the distance from the vertical section 35 of the second soldering member 33 to the second end portion 11 so that the soldering portions 36 of the first soldering member 32 and the second soldering member 33 are offset with each other in the front-to-rear direction in a side elevational view.

The thickness of the horizontal sections 34 are less than the height of the corresponding mounting slot 112, and the horizontal sections 34 are flat shape so that the first soldering member 32 and the second soldering member 33 are movably mounted in the mounting slot 112. The hook 314 of the metal arm 31 is disposed under the locking portion 121 to lock with a lower portion of the plastic arm 12, the metal arm 31 moves together with plastic arm 12 via the hook 314 when the plastic arm 12 moves outwardly. The stopping portion 315 is L-shaped and latches with the notch 37 to prevent the first soldering member 32 and the second soldering member 33 from forwardly extending away from the end portion 11 and further to prevent the locking arm 14 from upwardly moving overly. Due to holding force between the soldering portion 36 and the circuit board, the L-shaped stopping portion 315 can prevent the excessive outward movement of the plastic arm 12.

Due to the large number of the conducive terminal 2, the elongated base portion 10 may be distorted by the heat when the card edge connector 100 is soldered on the circuit board, it is resulting that the soldering portions 36 of the first soldering member 32 and the second soldering member 33 are located on different flats. The first soldering member 32 and the second soldering member 33 are movably mounted in the mounting slot, which can make the horizontal sections 34 floating up and down in the mounting slot 112 to adjust the first soldering member 32 and the second soldering member 33, so that the soldering portions 36 of the first soldering member 32 and the second soldering member 33 can be attached to the printed circuit board to improve the coplanarity of the card edge connector. It is noted that the first soldering member 32 and the second soldering member 33 are configured/dimensioned to comply with the soldering pads on the mother board while the metal arms 31 may keep the same configuration/dimension disregarding how much the positions of the soldering pads are changed. In other words, the cooperation of the soldering member and the corresponding metal arm may not only provide the so-called floating effect for coplanarity consideration but also the flexibility of manufacturing/assembling with the lower cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector for connecting an electrical card to a printed circuit board, comprising:

an insulative housing defining an elongated base portion, a first and a second end portions located on both ends of the base portion, the base portion defining a central slot extending along a longitudinal direction for receiving the electrical card;

a pair of plastic arms extending from the first and second end portions respectively;

a pair of metal arms attached to the plastic arms to form locking arms respectively; and a first and second soldering members attached to the end portions and co-operation with corresponding metal arms respectively, the first and second soldering members defining solder portions; wherein from a side view of the card edge connector, the solder portions of the first and second soldering members are offset from each other with a distance along a front-to-rear direction perpendicular to said longitudinal direction.

2. A card edge connector for connecting an electrical card to a printed circuit board, comprising:

an insulative housing defining an elongated base portion, first and second end portions located on both ends of the base portion, and a pair of locking arms respectively extending forwardly from the first and second end portions, the base portion defining a central slot extending along a longitudinal direction for receiving the electrical card;

a plurality of conductive terminals received in the insulative housing and projecting into the central slot;

a first soldering member mounted on the first end portion and including a soldering portion located below the corresponding locking arm for soldering on the printed circuit board; and a second soldering member mounted on the second end portion and including a soldering portion located below the corresponding locking arm for soldering on the printed circuit board; wherein a first distance between the soldering portion of the first soldering member and the first end portion in a front-to-rear direction is different from a second distance between the soldering portion of the second soldering member and the second end portion in the front-to-rear direction.

3. The card edge connector as described in claim 2, wherein the locking arms each including a plastic arm extending forwardly from the corresponding end portion and a metal arm attaching to an outer face of the plastic arm, the metal arms respectively prevent the first and second soldering members from forwardly breaking away from the first and second end portions.

4. The card edge connector as described in claim 3, wherein each of the first and second soldering members includes a horizontal section extending into the corresponding one of first and second end portions, a vertical section bending downwardly from the horizontal section and a soldering portion bending from the end of the vertical section, the vertical section of the first soldering member outward bends from one side edge of the horizontal section from a middle portion thereof.

5. The card edge connector as described in claim 4, wherein the horizontal section of the second soldering member forwardly extends to provide a connecting portion at a front end thereof, and the vertical section of the second soldering member outwardly bends from the connecting portion.

6. The card edge connector as described in claim 5, wherein the horizontal sections each define a notch at a front end thereof, and the distance between the notch of the first soldering member and the first end portion is similar to the distance between the notch of the second soldering member and the corresponding second end portion in the front-to-rear direction.

7. The card edge connector as described in claim 6, wherein each end portion defines a mounting slot located below the plastic arm, each horizontal section is mounted in the corresponding mounting slot and floating up and down in the mounting slot.

8. The card edge connector as described in claim 7, wherein each metal arm is vertically attached to the outer face of the corresponding plastic arm and retained in a corresponding end portion by a barb disposed at a rear portion thereof.

9. The card edge connector as described in claim 8, wherein each metal arm defines a blocking portion extending inwardly to engage the electrical card and a hook bending in a front end to engage the plastic arm in the front end thereof, the blocking portion and the hook are located in the same side of the metal arm, and the hook is located below the blocking portion.

10. The card edge connector as described in claim 9, wherein the plurality of conductive terminals are grouped into a first set of terminals and a second set of terminals, each conductive terminal defines a contacting portion projecting into the central slot and a soldering portion extending outer side of the base portion, and the contacting portions of the first set of terminals and the second set of terminals are located on the upper and lower sides of the central slot respectively and offer set in the front-to-rear direction.

11. The card edge connector as described in claim 10, wherein each conductive terminal defines a body portion connecting with the contacting portion and the soldering portion, the body portion defines a first retaining portion and a second retaining portion extending into the base portion, the first and second retaining portions are set in different heights in a vertical direction.

12. The card edge connector as described in claim 11, wherein the first retaining portion of each terminal of the second set of terminals has a hollow hole.

13. A card edge connector for use with a memory module with a pair of notches in two opposite side edges, comprising:

an insulative housing defining a horizontal slot extending along a lengthwise direction between two opposite end portions for receiving said memory module;

a plurality of contacts disposed in the housing with corresponding contacting sections extending into the horizontal slot;

a pair of metal arms fixed to the corresponding end portions, respectively, each of said metal arms extending forwardly in a front-to-back direction perpendicular to said lengthwise direction, each of said metal arms dimensioned to define around a distal end thereof a blocking portion adapted to confront the memory module around the corresponding notch; and a pair of soldering members respectively disposed in the corresponding end portions, respectively, each of said soldering members defining a horizontally extending main section with a root retained in the corresponding end portion, a horizontal soldering portion extending from and located below the main section via a vertical section with a downward horizontal soldering surface, and an engagement section far away from the root to engaged with the corresponding metal arm for preventing forward withdrawal of the soldering member from the corresponding end portion; wherein the horizontal soldering portions of said pair of soldering members are located at different positions with regard to the housing in the front-to-back direction, and the corresponding vertical sections extend from the corresponding main sections at different positions in said front-to-back direction correspondingly.

14. The card edge connector as claimed in claim 13, wherein said pair of soldering members are floatable in a vertical direction perpendicular to both said lengthwise direction and said front-to-back direction before mounting to a printed circuit board.

15. The card edge connector as claimed in claim 13, wherein the engagement sections of the pair of soldering members and the corresponding pair of metals are engaged with each other at different positions in a same position in said front-to-back direction.

16. The card edge connector as claimed in claim 15, wherein the pair of metal arms are symmetrically arranged with each other in a mirror image status.

17. The card edge connector as claimed in claim 13, wherein said main sections of the pair of soldering members are dimensioned and configured differently from each other.

18. The card edge connector as claimed in claim 13, wherein the main sections of said pair of soldering members are located at different levels in a vertical direction perpendicular to both said lengthwise direction and said front-to-back direction.

19. The card edge connector as claimed in claim 13, wherein a position where the engagement section of one of said pair of soldering members and the corresponding side arm are engaged, is located behind the corresponding soldering portion of the same soldering member in the front-to-back direction while another position wherein the engagement section of the other of said pair of soldering members and the corresponding side are engaged with each other, is located in front of the corresponding soldering portion of the same soldering member.

20. The card edge connector as claimed in claim 13, wherein the horizontally extending main section defines thereof a thickness direction which is perpendicular to both said lengthwise direction and said front-to-back direction.

* * * * *